US007080634B2

(12) United States Patent
Yamashita

(10) Patent No.: US 7,080,634 B2
(45) Date of Patent: Jul. 25, 2006

(54) EGR COOLER

(75) Inventor: Yoji Yamashita, Tokyo (JP)

(73) Assignees: Hino Motors, Ltd., Tokyo (JP); Sankyo Radiator Co., Ltd., Tokyo (JP)

( * ) Notice: Subject to any disclaimer, the term of this patent is extended or adjusted under 35 U.S.C. 154(b) by 0 days.

(21) Appl. No.: 10/517,313

(22) PCT Filed: May 22, 2003

(86) PCT No.: PCT/JP03/06400

§ 371 (c)(1),
(2), (4) Date: Dec. 17, 2004

(87) PCT Pub. No.: WO04/001314

PCT Pub. Date: Dec. 31, 2003

(65) Prior Publication Data

US 2005/0199228 A1 Sep. 15, 2005

(30) Foreign Application Priority Data

Jun. 21, 2002 (JP) ..... 2002-181757

(51) Int. Cl.
*F02M 25/10* (2006.01)
*F02M 25/00* (2006.01)

(52) U.S. Cl. ..... 123/568.12; 165/179; 165/184

(58) Field of Classification Search ..... 123/568.12, 123/547; 165/133, 179, 184, DIG. 535; 60/320, 278

See application file for complete search history.

(56) References Cited

U.S. PATENT DOCUMENTS

| | | | | |
|---|---|---|---|---|
| 3,088,494 | A * | 5/1963 | Koch et al. | 138/37 |
| 3,826,304 | A * | 7/1974 | Withers et al. | 165/179 |
| 4,081,913 | A * | 4/1978 | Salminen | 34/454 |
| 4,118,944 | A * | 10/1978 | Lord et al. | 62/98 |
| 4,290,389 | A * | 9/1981 | Palchik | 122/406.4 |
| 4,660,630 | A * | 4/1987 | Cunningham et al. | 165/133 |
| 5,655,599 | A | 8/1997 | Kasprzyk | |
| 6,164,370 | A * | 12/2000 | Robinson et al. | 165/133 |
| 6,173,763 | B1 * | 1/2001 | Sano et al. | 165/133 |
| 6,647,971 | B1 * | 11/2003 | Vaughan et al. | 123/568.12 |
| 6,684,938 | B1 * | 2/2004 | Tsujita et al. | 165/51 |
| 6,883,597 | B1 * | 4/2005 | Thors et al. | 165/133 |

FOREIGN PATENT DOCUMENTS

| | | |
|---|---|---|
| JP | 2001-254649 | 9/2001 |
| JP | 2001-304047 | 10/2001 |

* cited by examiner

*Primary Examiner*—Mahmoud Gimie
(74) *Attorney, Agent, or Firm*—Oblon, Spivak, McClelland, Maier & Neustadt, P.C.

(57) ABSTRACT

An EGR cooler has tubes and a shell for enclosing the tubes. Cooling water is supplied into and discharged from the shell and exhaust gas from a diesel engine is guided into each of the tubes so as to conduct heat exchange of the exhaust gas with the cooling water. An inner periphery of each of the tubes is formed with spiral protrusions each having an inclination angle in a range of 26°–50° to a plane perpendicular to an axis of the tube.

8 Claims, 3 Drawing Sheets

EGR COOLER

TECHNICAL FIELD

The present invention relates to an EGR cooler attached to an EGR apparatus, which recirculates exhaust gas from a diesel engine to suppress generation of nitrogen oxides, so as to cool the exhaust gas for recirculation.

BACKGROUND ART

Known is an EGR apparatus which recirculates part of exhaust gas from an engine in a vehicle or the like to the engine to suppress generation of nitrogen oxides. Some of such EGR apparatuses are equipped with, midway of an exhaust gas recirculation line to the engine, an EGR cooler for cooling the exhaust gas since cooling the exhaust gas to be recirculated to the engine will drop the temperature of and reduce the volume of the exhaust gas to lower the combustion temperature in the engine without substantial decrease in output of the engine, thereby effectively suppressing generation of nitrogen oxides.

FIG. 1 is a sectional view showing an example of the EGR coolers in which reference numeral 1 denotes a cylindrical shell with axially opposite ends to which plates 2 are respectively fixed so as to close the ends of the shell 1. Penetratingly fixed to the respective plates 2 are opposite ends of a number of tubes 3 which extend axially within the shell 1.

The shell 1 is provided with an outer cooling water inlet pipe 4 in the vicinity of one end of the shell 1 and with an outer cooling water outlet pipe 5 in the vicinity of the other end of the shell 1 so that cooling water 9 is supplied via the cooling water inlet pipe 4 into the shell 1, flows outside of the tubes 3 and is discharged via the cooling water outlet pipe 5 from the shell 1.

The respective plates 2 have, on their sides away from the shell 1, bowl-shaped hoods 6 fixed to the respective plates 2 so as to enclose end faces of the plates. The one and the other hoods 6 provide central exhaust gas inlet and outlet 7 and 8, respectively, so that exhaust gas 10 from the engine enters via the exhaust gas inlet 7 into the one hood 6, is cooled during passage through the number of tubes 3 by means of heat exchange with cooling water 9 flowing outside of the tubes 3 and is discharged to the other hood 6 to be recirculated via the exhaust gas outlet 8 to the engine.

In the figure, reference numeral 11 denotes a bypass outlet pipe arranged at a position diametrically opposed to the cooling water inlet pipe 4, part of the cooling water 9 being withdrawn through the bypass outlet pipe 11 so as to prevent the cooling water 9 from stagnating at the position diametrically opposed to the cooling water inlet pipe 4.

Such conventional EGR cooler has poor heat exchange efficiency since the exhaust gas 10 flows straight in the tubes 3 and insufficiently contacts the inner peripheries of the tubes 3. Therefore, it has been proposed that an inner periphery of the tube 3 is formed with spiral protrusions to causes the exhaust gas 10 passing through the tube 3 to be whirled, thereby increasing contact frequency and contact distance of the exhaust gas 10 to the inner periphery of the tube 3 to enhance the heat exchange efficiency of the EGR cooler.

However, a design concept conventionally adopted for formation of a spiral protrusion on the inner periphery of the tube 3 is such that an inclination angle (to a plane perpendicular to an axis of the tube 3) of the spiral protrusion is minimized in merely focusing attention on initial performance value. It has been revealed, from experimental results by the inventor, that application of such design concept to a diesel engine from which the exhaust gas 10 with much sooty contents is discharged disturbs the flow of the exhaust gas 10 since the inclination angle of the spiral protrusion is small, resulting in an accumulation of soot within the tube 3 with a lapse of time, thus substantially lowering the heat exchange efficiency.

The invention was made in view of the above and has its object to provide an EGR cooler which can be satisfactorily applied to an diesel engine with no substantial lowering in performance.

SUMMARY OF THE INVENTION

The invention is directed to an EGR cooler comprising tubes and a shell for enclosing said tubes, cooling water being supplied into and discharged from the shell, exhaust gas from a diesel engine being guided into said tubes to be heat exchanged with said cooling water, characterized in that an inner periphery of each of said tubes is formed with a spiral protrusion with an inclination angle in a range of 26°–50° to a plane perpendicular to an axis of the tube.

Such inclination angle of the spiral protrusion set to 26°–50° is slightly inferior in imtial performance value on heat exchange efficiency in comparison with an inclination angle of less than 26°, but keeps the exhaust gas in a state so as to have less pressure loss and causes it to flow smoothly with a tendency of the soot not to accumulate on the inner periphery of the tube, and therefore is superior in eventual performance value on heat exchange efficiency after deterioration; in view of long use thereafter, it turns out that there is a prolonged time period with good heat exchange efficiency maintained.

In fact, it has been ensured by the inventor's experiments that the inclination angle of spiral protrusion being set to less than 26° increases the pressure loss so that soot tends to accumulate in the tube, resulting in a substantial lowering in performance. It has been also ensured that, with the inclination angle of the spiral protrusion in a range of 26°–50°, the eventual performance value after deterioration substantially stays flat.

On the other hand, it has been ensured that even with the inclination angle being more than 50°, such hardly contributes to a lowering in pressure loss of the exhaust gas while an amount of heat exchanged tends to be drastically decreased by a slight increase in inclination angle. Moreover, insufficiency of whirling force afforded to the exhaust gas remarkably impairs the function of the soot in the exhaust gas gathering to the whirling axis. As a result, inversely there may be a tendency of the soot to accumulate on the inner periphery of the tube.

Moreover, according to the invention, preferably the inner periphery of the tube is formed with a plurality of strands of spiral protrusions running without crossing and with phases peripherally shifted with respect to each other. This enables the axial pitch of the protrusions to be decreased with an inclination angle of the spiral protrusion of more than 26°, whereby whirling force of the exhaust gas can be increased without increasing the pressure loss.

When the inclination angle of the spiral protrusion is set to a range of 26°–50°, it is preferable that ridge height of the spiral protrusion to the inner periphery of the tube is 5–15% of the inner diameter of the tube.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

BEST MODE FOR CARRYING OUT THE INVENTION

Now embodiments of the invention will be described on the basis of the drawings.

Figure 1:
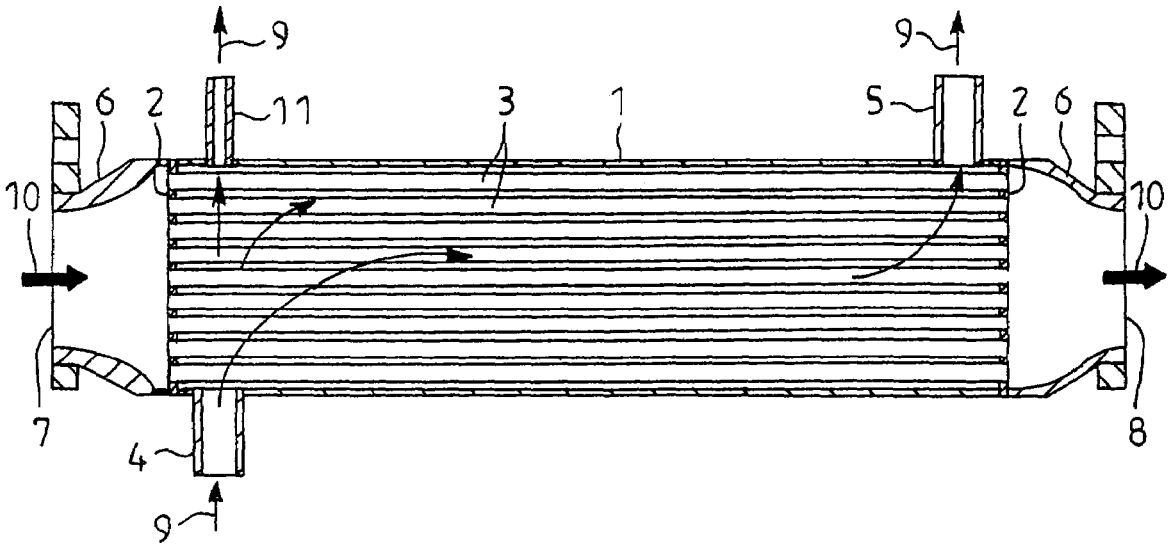
FIG. 1 PRIOR ART
FIG. 1 is a sectional view showing an example of a conventional EGR cooler.
Figure 2:
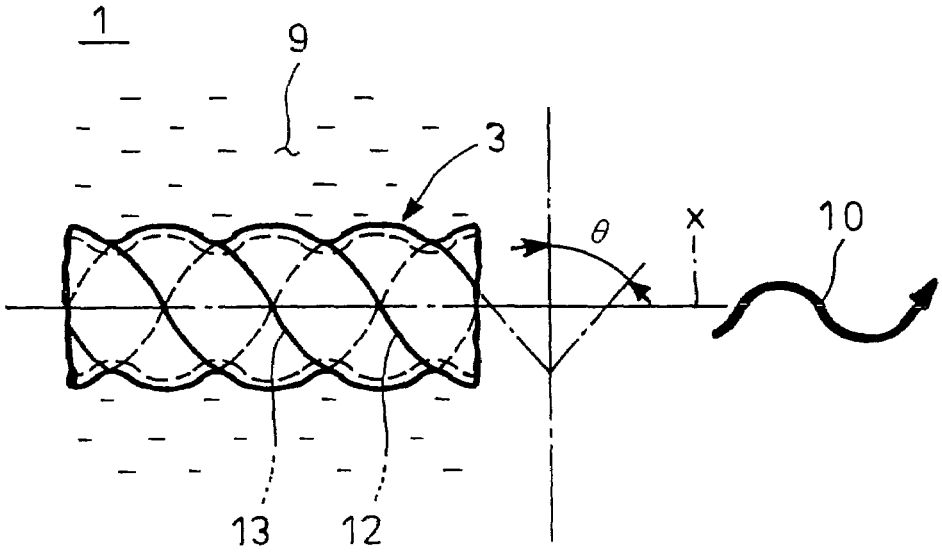
FIG. 2 is a side view showing an embodiment of the invention.

FIG. 2 shows an embodiment according to the invention in which parts similar to those in FIG. 1 are designated by the same reference numerals.

As shown in FIG. 2, this embodiment is directed to an EGR cooler constructed substantially in the same manner as described above with respect to FIG. 1, and an inner periphery of the tube 3 through which exhaust gas 10 passes is formed with a plurality of streaks of spiral protrusions 12 and 13 with inclination angle θ being in a range of 26°–50° relative to a plane perpendicular to an axis of the tube 3. In the example shown, two streaks of spiral protrusions 12 and 13 run without crossing and with phases peripherally shifted 180° with respect to each other.

If the tube 3 is thin in terms of wall thickness, the spiral protrusions 12 and 13 may be formed by spirally indenting the tube 3 from outside by means of, for example, a roll having spiral convex streaks, so that portions pressed from outside provide the spiral protrusions 12 and 13 on the inner periphery of the tube 3.

If the tube 3 is thick in terms of wall thickness, the spiral protrusions 12 and 13 may be formed by cutting the inner periphery of the tube 3 so as to leave the spiral protrusions 12 and 13.

Figure 3:
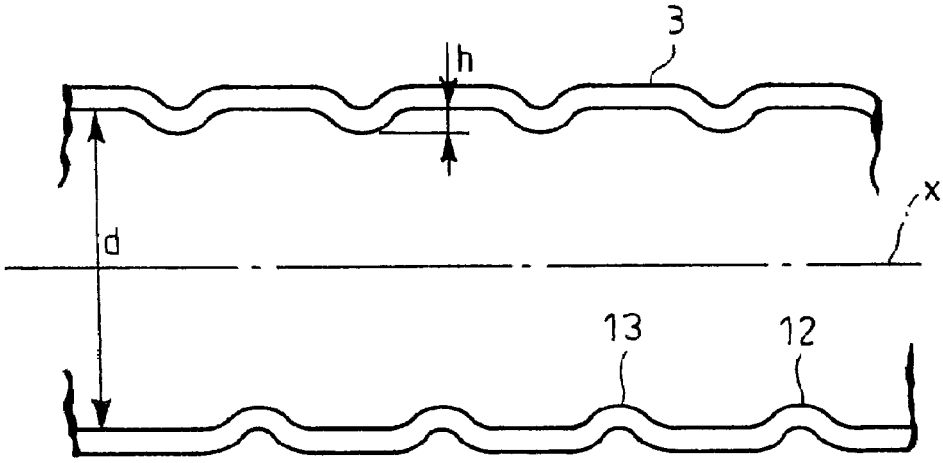
FIG. 3 is a schematic section showing the ridge height of spiral protrusion in FIG. 2.

As shown in FIG. 3, when the inclination angle θ of the spiral protrusions 12 and 13 is set to the range of 26°–50°, the ridge height h of the spiral protrusions 12 and 13 to the inner periphery of the tube 3 is preferably 5–15% of the inner diameter d of the tube 3.

While the ridge height h of the spiral protrusions 12 and 13 being more than 15% would result in worthless increase of pressure loss, a ridge height being less than 5% would result in too small a whirling force by the spiral protrusions 12 and 13 and loose the worth of forming the spiral protrusions 12 and 13.

Thus, such inclination angle θ of the spiral protrusions 12 and 13 set to the range of 26°–50° is slightly inferior in initial performance value in terms of heat exchange efficiency in comparison with an inclination angle θ of less than 26°, but keeps the exhaust gas 10 to have less pressure loss and causes it to flow smoothly with tendency of the soot not to accumulate on the inner periphery of the tube 3, and therefore is superior in eventual performance value in terms of heat exchange efficiency after deterioration. In view of long use thereafter, it turns out that there is a prolonged time period with good heat exchange efficiency maintained.

Figure 4:
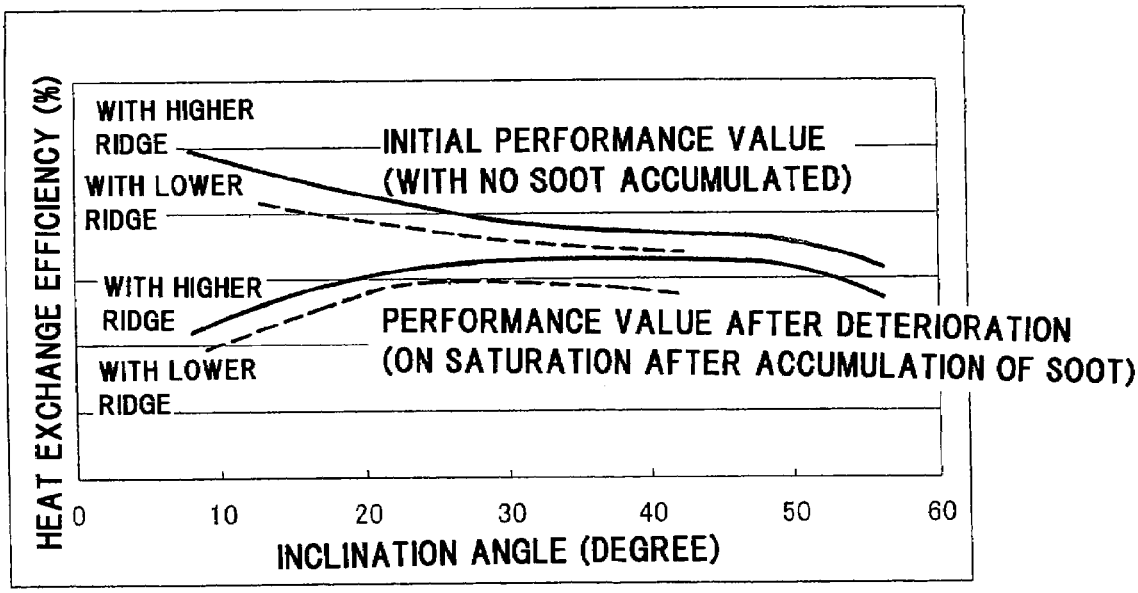
FIG. 4 is a graph showing a relationship between the heat exchange efficiency and inclination angle of the spiral protrusion.

In fact, according to experiments conducted by the inventor, experimental results have been obtained for example as shown in the graph in FIG. 4 (which shows relationship between heat exchange efficiency and inclination angle). As is clear from this graph, it has been ensured that an inclination angle θ of the spiral protrusions 12 and 13 of less than 26° increases the pressure loss so that soot tends to accumulate in the tube 3, resulting in substantial lowering in performance (lowering in heat exchange efficiency). It has been also ensured that, with the inclination angle θ of the spiral protrusions 12 and 13 in the range of 26°–50°, the eventual performance value after deterioration stays substantially flat. The graph in FIG. 4 shows, with respect to two examples of the spiral protrusions 12 and 13 with different ridge heights, differences between initial performance value and eventual performance value after deterioration.

Now, eventual performance value after deterioration will be explained. With a lapse of time after activation of the EGR cooler, accumulation of soot in the tube 3 progresses, which lowers the heat exchange efficiency and increases the pressure loss of the exhaust gas 10, finally maturing into a (saturated) state where accumulation of soot does not increase any more to stabilize the heat exchange efficiency and the pressure loss. The performance value at this stage is regarded as the eventual performance value after deterioration.

Studying an appropriately sized EGR cooler in view of its mountability into an engine room on the basis of the various experimental results as mentioned above leads to a most effective and suitable condition and that the inclination angle θ of the spiral protrusions 12 and 13 is specified into the range of 26°–50°.

Figure 5:
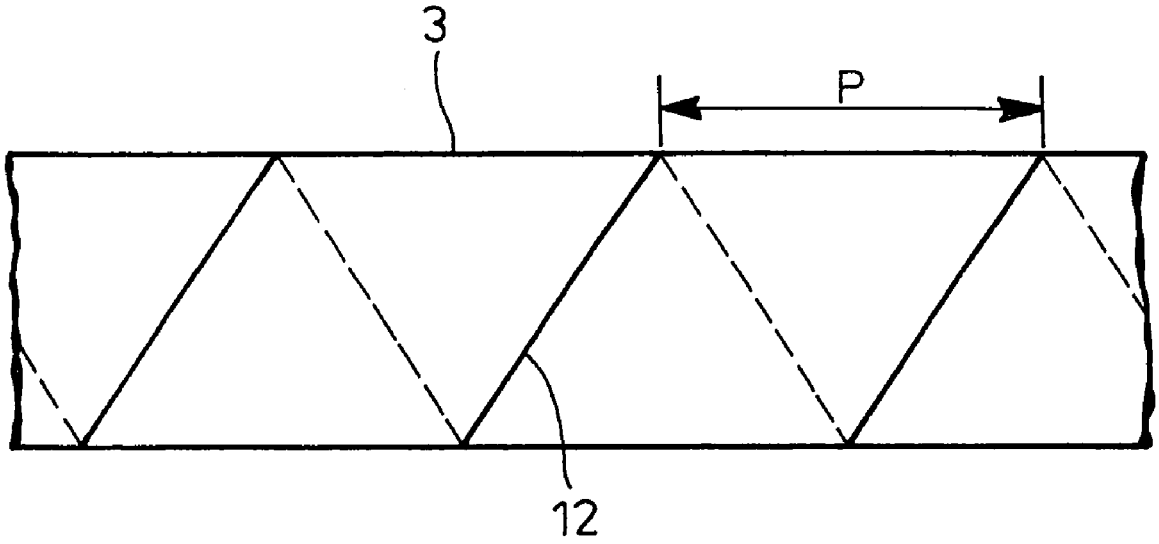
FIG. 5 is an illustration of the pitch when the protrusion is in one streak.
Figure 6:
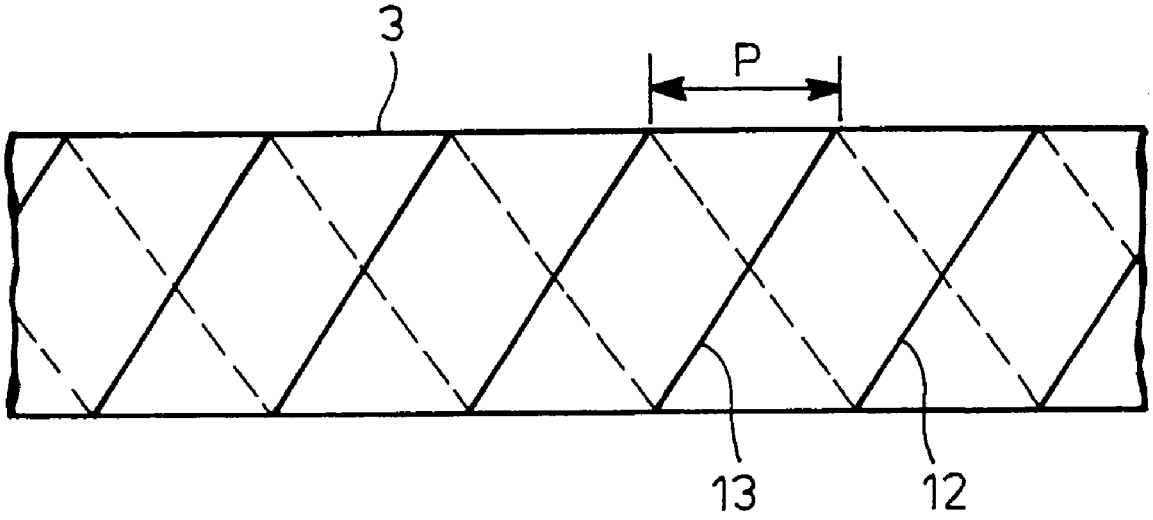
FIG. 6 is an illustration on the pitch when the protrusions are in two streaks.

When the inclination angle θ of the spiral protrusions 12 and 13 is set to the range of 26°–50°, and if the single strand of spiral protrusion 12 is used as schematically shown in FIG. 5, the axial pitch P of the spiral protrusion 12 is inevitably increased; however, if two streaks of spiral protrusions 12 and 13 are used as schematically shown in FIG. 6, the spiral protrusions 12 and 13 may have inclination angle θ of more than 26° while the axial pitch P of the spiral protrusions 12 and 13 may be shortened, whereby the whirling force of the exhaust gas 10 can be enhanced without increasing the pressure loss.

Thus, according to the present embodiment, in order to make the exhaust gas 10 flow spirally within the heat tube 3 for the purpose of enhancing the heat exchange efficiency, the inclination angle θ of the spiral protrusions 12 and 13 is set to the range of 26°–50° so that accumulation of the soot on the inner periphery of the tube 3 can be suppressed to maintain higher the eventual performance value after deterioration than that in the conventional design concept which merely focuses attention on initial performance value, whereby an EGR cooler can be provided which can be satisfactorily applied with no substantial lowering in performance to a diesel engine from which is discharged exhaust gas 10 rich with sooty contents.

Especially in this embodiment, the inner periphery of the tube 3 is formed with two streaks of spiral protrusions 12 and 13 running without crossing and with phases peripherally shifted to each other, so that the axial pitch P of the protrusions 12 and 13 can be decreased with the inclination angle θ of the spiral protrusions 12 and 13 being more than 26°, which enables the whirling force of the exhaust gas 10 to be increased without increasing the pressure loss.

INDUSTRIAL APPLICABILITY

As described above, an EGR cooler according to the invention exhibits the following excellent features and advantages, (I) In order to make the exhaust gas flow spirally within the tube for the purpose of enhancing the heat exchange efficiency, the inclination angle of the spiral protrusion is set to a range of 26°–50° so that accumulation of soot on the inner periphery of the tube can be suppressed to maintain a higher eventual performance value after deterioration than that in the conventional design concept which merely focuses attention on initial performance value, whereby an EGR cooler is provided which can be satisfactorily applied with no substantial lowering in performance to a diesel engine from which is discharged exhaust gas rich with sooty contents.

(II) Adoption of a plurality of streaks of spiral protrusions on the inner periphery of the tube running without crossing and with phases peripherally shifted to each other enables the axial pitch of the protrusions to be decreased with the inclination angle of the spiral protrusion being more than 26°, whereby whirling force of the exhaust gas can be increased without increasing the pressure loss.

The invention claimed is:

1. An EGR cooler, comprising:

tubes and a shell for enclosing said tubes, cooling water being supplied into and discharged from said shell, exhaust gas from a diesel engine being guided into said tubes to be heat exchanged with said cooling water, wherein an inner periphery of each of said tubes is formed with a spiral protrusion with an inclination angle θ in a range of 26°–50° to a plane perpendicular to an axis of the tube, wherein said inclination angle is in a range of 26°–44°.

2. The EGR cooler according to claim 1, wherein an inner periphery of each of the tubes is formed with a plurality of streaks of spiral protrusions running without crossing and with phases peripherally shifted with respect to each other.

3. The EGR cooler according to claim 1, wherein the height of the spiral protrusion with respect to an inner periphery of the tube is 5–15% of an inner diameter of the tube.

4. The EGR cooler according to claim 2, wherein the height of the spiral protrusion with respect to an inner periphery of the tube is 5–15% of an inner diameter of the tube.

5. An EGR cooler, comprising:

tubes and a shell for enclosing said tubes, cooling water being supplied into and discharged from said shell, exhaust gas from a diesel engine being guided into said tubes to be heat exchanged with said cooling water, wherein an inner periphery of each of said tubes is formed with a spiral protrusion with an inclination angle θ in a range of 26°–50° to a plane perpendicular to an axis of the tube, and wherein said spiral protrusions correspond to spiral indentations formed in an exterior surface of each of said tubes.

6. The EGR cooler according to claim 5, wherein an inner periphery of each of the tubes is formed with a plurality of streaks of spiral protrusions running without crossing and with phases peripherally shifted with respect to each other.

7. The EGR cooler according to claim 5, wherein the height of the spiral protrusion with respect to an inner periphery of the tube is 5–15% of an inner diameter of the tube.

8. The EGR cooler according to claim 6, wherein the height of the spiral protrusion with respect to an inner periphery of the tube is 5–15% of an inner diameter of the tube.

* * * * *